United States Patent [19]

Lotspeich et al.

[11] 4,209,111

[45] Jun. 24, 1980

[54] SHELF LOCKING APPARATUS

[75] Inventors: Joseph A. Lotspeich, South Saint Paul; Raymond W. Pertinen, Minneapolis, both of Minn.

[73] Assignee: Gross-Given Manufacturing Company, Saint Paul, Minn.

[21] Appl. No.: 949,046

[22] Filed: Oct. 6, 1978

[51] Int. Cl.[2] ..... G07F 11/00

[52] U.S. Cl. ..... 221/75; 221/281

[58] Field of Search ..... 221/75, 197, 198, 281; 312/333, 348, 350, 222, 35

[56] References Cited

U.S. PATENT DOCUMENTS

| | | | |
|---|---|---|---|
| 3,344,953 | 10/1967 | Krakauer | 221/75 |
| 3,575,480 | 4/1971 | Peisker | 312/218 |
| 3,653,540 | 4/1972 | Offutt | 221/75 |
| 4,046,440 | 9/1977 | Cox et al. | 221/75 |
| 4,138,174 | 2/1979 | Cox et al. | 221/281 |

*Primary Examiner*—Allen N. Knowles

*Attorney, Agent, or Firm*—Merchant, Gould, Smith, Edell, Welter & Schmidt

[57] ABSTRACT

An improved locking apparatus for a slidably mounted product carrying shelf in a helical coil vending machine. Each shelf includes a front roller normally retained in a front stop. The locking apparatus comprises a pivotably mounted lock member mounted above the front stop of each shelf. The lock member has a lock surface which in a first or normal position of the lock member prevents the front roller from being removed from the front stop to lock the shelf in position in the vending machine. The lock member may be rotated to either a second or third position where the lock surface clears the front roller to allow the shelf to be slid out of the vending machine. The lock member is counterweighted such that it will remain in its third position to allow an operator to completely remove the shelf from the vending machine.

9 Claims, 3 Drawing Figures

SHELF LOCKING APPARATUS

BACKGROUND OF THE INVENTION

1. Field of the Invention

This invention relates to automatic vending machines having suitable means for selectively dispensing food products to a purchaser. More particularly, this invention relates to a vending machine having a plurality of vertically spaced shelves located in a housing wherein each of the shelves is slidably mounted in the housing for movement between a normal retracted dispensing position and an outwardly located product loading position.

2. Description of the Prior Art

Automated vending machines are well-known for dispensing food products upon insertion by a purchaser of a required amount of money. Such vending machines have various kinds of dispensing mechanisms depending on the particular types of food products which are being vended. One well-known class of vending machines is that known in the trade as helical coil vending machines or, alternatively, as spiral vendors. U.S. Pat. No. 4,061,245, issued to Joseph A. Lotspeich on Dec. 6, 1977, and assigned to the assignee of the present invention, is a typical example of a helical coil vending machine. Such machines are widely used for dispensing pre-packaged food products including rolled candy, mints and the like, and so-called "snack" products such as potato chips and pastries.

Most helical coil dispensing machines customarily include a housing which supports a plurality of vertically spaced shelves. Each of the shelves usually includes a plurality of elongated dispensing coils which run from front to back on the shelf. The rear end of each dispensing coil is operatively connected to an electric motor for selectively rotating the coil. Upon each consecutive rotation of the coil, the food product held in the foremost convolution is dispensed over the end of the shelf into a discharge space.

The shelves in many helical coil vending machines may be slid out of the machine housing when a door is opened to allow a service man to easily fill the coils with the food products to be dispensed. If the shelves could not be pulled out of the machine, the task of loading the machine would be difficult due to the lack of clearance space between adjacent shelves and the consequent difficulty in reaching the rearmost convolutions of the coil. Furthermore, there are times when each of the shelves are desirably completely removed from the housing rather than being only partially slid out for the purposes of reloading the shelf. Such complete removal may be needed if maintenance must be performed on any of the motor or control mechanisms located behind the shelf.

In "full size" helical coil vending machines of the type discussed above, a relatively complicated door and shelf interlock system is often used whenever the shelves are slidably mounted in the housing. Such an interlock system prevents inadvertent damage to the door and/or the shelves by preventing the shelves from being pulled out until the door is completely open and by preventing the door from being closed until each of the shelves has been replaced in the housing in its normal retracted orientation. One example of such a door and shelf interlock system is shown in U.S. Pat. No. 4,046,440 to Cox et al. Another example of another door and shelf interlock system is illustrated in U.S. patent application Ser. No. 888,138, entitled Vendor with Door and Shelf Interlock, filed on Mar. 20, 1978, and assigned to the assignee of this invention.

While such door and shelf interlock systems are eminently suited for the purpose for which they are designed, they are not economically practical in all situations. For example, current trends in the vending machine industry include the utilization of helical coil vending machines which are somewhat smaller than those of the prior art. In this new generation of vending machines, economy is a very important consideration. Thus, these "smaller" vending machines have fewer dispensing shelves than their "full-size" counterparts. They also do not have separate gum and mint dispensers as is used in the "full-size" machines. Although it is still desired that each of the shelves be slidable into and out of the machine for the purposes of shelf loading and removal, the likelihood of damaging the door and shelves of such a machine are not quite as great because of its smaller size. Thus, the conventional door and shelf interlock systems of the prior art are too expensive from a cost benefits standpoint to justify their use in the new and smaller vending machines. Nonetheless, there is still a need for locking the shelves inside the housing in a normal vending position, but yet allowing the shelves to be easily removed from the housing for the purposes of loading or removal.

SUMMARY OF THE INVENTION

One aspect of this invention relates to a helical coil vending machine in which a relatively simple and inexpensive locking apparatus is provided for locking each of the vending machine shelves in a dispensing position, but which can be selectively actuated to allow either partial or complete shelf removal.

Each of the vending machine shelves is slidably mounted in a housing by a plurality of shelf support members which are received in opposed tracks or channels on either side of the vending machine housing. A front stop is located at the front end of each channel. The front stop bears against the front shelf support member to retain the shelf in a dispensing position. However, the front end of each shelf can be tilted upwardly so that the front shelf support member clears the front stop to allow either partial or complete removal of the vending machine shelf from the housing.

This invention relates to a lock member which is pivotably mounted above one front stop of each of the vending machine shelves. The lock member has a counterweighted cam configured to be located in an interfering or locking relationship with the front shelf support member in a first position of the lock member. The lock member may be manually rotated and held by hand pressure to a second position where the cam clears the front shelf support member and allows the shelf to be slid out of the housing for reloading. In addition, to allow complete removal of the shelf from the vending machine housing, the lock member may be rotated to a third position where the cam also clears the front shelf support member and is in addition retained in the third position by the counterweighted configuration of the cam. This allows the operator to use both hands to completely remove the shelf from the vending machine housing.

BRIEF DESCRIPTION OF THE DRAWINGS

This invention will be described hereafter in the Detailed Description, when taken in conjunction with the following drawings, in which like reference numerals will refer to like elements throughout.

DETAILED DESCRIPTION

Figure 1:
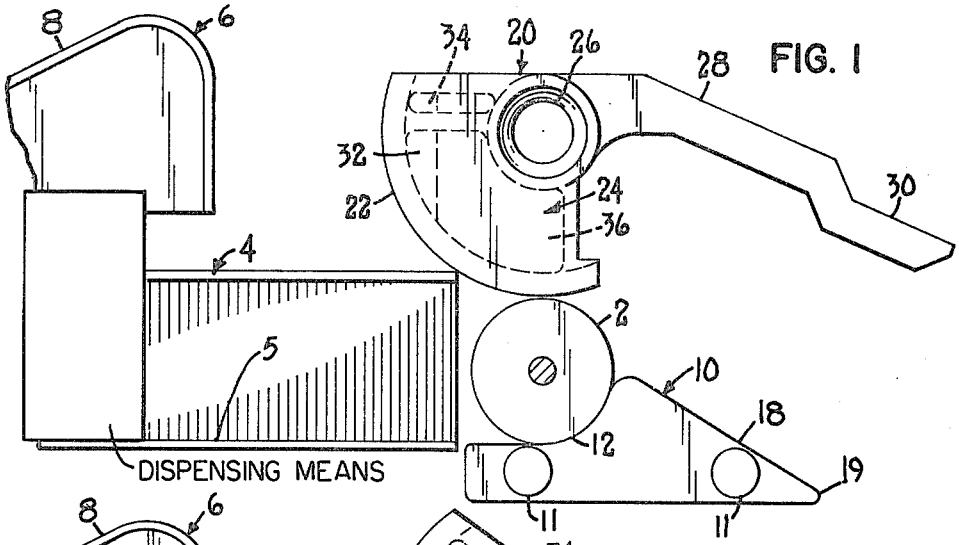
FIG. 1 is a side elevational view of the locking apparatus according to this invention, particularly illustrating the cam of the lock member in an interfering relationship with the front roller of one of the shelves of the vending machine.

This invention relates generally to a locking apparatus for a vending machine shelf. The vending machine with which this invention is meant for use has not been specifically illustrated in the drawings. However, this vending machine is of the same general type shown in U.S. Pat. No. 4,061,245, issued to Joseph A. Lotspeich on Dec. 6, 1977, and assigned to the assignee of this invention. Such a vending machine is used for dispensing pre-packaged food products or any other suitable articles. The vending machine is of the helical coil type in which the products to be vended are received between the convolutions of the coils.

Generally, the vending machine utilizing the present invention includes a substantially rectangular housing in which a plurality of vertically spaced shelves are arranged. Each shelf has a plurality of laterally projecting shelf support members, i.e. rollers, extending from each side thereof. These support rollers are respectively received in two opposed U-shaped channels located on either side of the housing at the same vertical elevation. By virtue of this engagement, the shelf is slidably mounted for movement in the vending machine housing between a normal dispensing position in which the shelf is wholly retracted inside the housing and a loading position in which the shelf extends at least partially outside the housing.

Referring now to FIG. 1, one of the shelf support rollers is generally illustrated as 2. Roller 2 is pivotably located on one side of the vending machine shelf (not shown) adjacent the front edge of the shelf and so may be termed the front shelf support member or the front roller. Two identically sized rollers (not shown) are also pivotably located on the same side of the shelf. These two rollers are located near the rear edge of the shelf and may be termed the rear support rollers. The rear support rollers are received inside the U-shaped track or channel which is generally indicated as 4. Although only the front portion of track 4 is shown in FIG. 1, track 4 extends rearwardly along the vending machine housing for a sufficiently long distance to adequately support the vending machine shelf. Each opposed side of the shelf has a series of three rollers identical to that described above.

Located above track 4 adjacent the front edge thereof is a support member 6 having an upwardly slanted track portion 8. Support member 6 cooperates with the rear support rollers (not shown) of each shelf to allow the shelf to be tilted downwardly when the shelf is pulled out to an extended loading position. For a further description of the vending machine and the details of the channels 4 and the manner of operation of the support member 6, reference can be had to the above-identified U.S. patent, which patent is hereby incorporated by reference.

A front stop 10 is fixedly located adjacent the front end of each track 4 by suitable securing members 11 (e.g., pins, rivets or the like). Front stop 10 has a first substantially horizontal surface 12 which is generally a continuation of the lower support surface 5 of track 4. Horizontal surface 12 terminates in a curved upwardly extending stop member generally indicated as 14. Stop member 14 has an apex 16. A downwardly slanted ramp or track 18 extends from the apex 16 to the front edge 19 of front stop 10. Whenever each of the shelves is in its retracted dispensing position inside the vending machine housing, the front roller 2 on each side of the shelf is located as shown in FIG. 1. In this regard, front roller 2 is located behind the curved stop member 14 and on top of the horizontal surface 12 such that the shelf is prevented from moving outwardly in the tracks 4.

This invention relates to a shelf locking apparatus for retaining each shelf in its dispensing position shown in FIG. 1. This locking apparatus includes one selectively actuable latch or lock member for each shelf which lock member is generally indicated as 20. Lock member 20 includes an arcuate locking surface 22 formed as the outer periphery of a pie-shaped cam 24. Cam 24 is located generally beneath and to one side of a circular aperture or bore 26. Any suitable type of pivot pin (not shown) can extend through bore 26 and into the side wall of the vending machine housing for the purpose of pivotably mounting lock member 20 in the vending machine. As shown in FIG. 1, the pivot axis of the lock member 20 (i.e., bore 26) is generally colinear with the axis of the front roller 2 when the front roller 2 is located in the front stop 10 with the locking surface 22 lying immediately above the front roller 2.

An outwardly extending handle 28 is further integrally formed with the bore 26 and the cam 24 as part of lock member 20. Handle 28 extends outwardly from the bore 26 along the side of the shelf a sufficient distance to be accessible to a vending machine operator standing in front of the shelf. Handle 28 is located on the opposite side of the bore 26 relative to the cam 24. In addition, handle 28 is not linear over its entire length, but has an offset or notched outer end 30. Lock member 20 is preferably integrally formed of any suitable materials. One preferred material is a high impact plastic with lock member 20 being formed in any conventional way (e.g., blow or injection molding). The cam 24 need not necessarily be a solid member. As shown in FIG. 1, cam 24 could have a unitary front face 32 and a plurality of weight reducing recesses 34 and 36 located behind the front face 32.

Cam 24 acts as a counterweight on lock member 20. Thus, lock member 20 has a combined center of gravity such that it naturally or normally occupies a first position as illustrated in FIG. 1. In such a position, the locking surface 22 of cam 24 is located immediately above the front roller 2 of the vending machine shelf. Thus, if one were to attempt to slide the shelf out of the vending machine housing, locking surface 22 would interfere with the movement of front roller 2 which is needed to clear the stop member 14. Consequently, in its first position shown in FIG. 1, the lock member 20 has effectively locked the shelf in its retracted dispensing position inside the vending machine housing.

Figure 2:
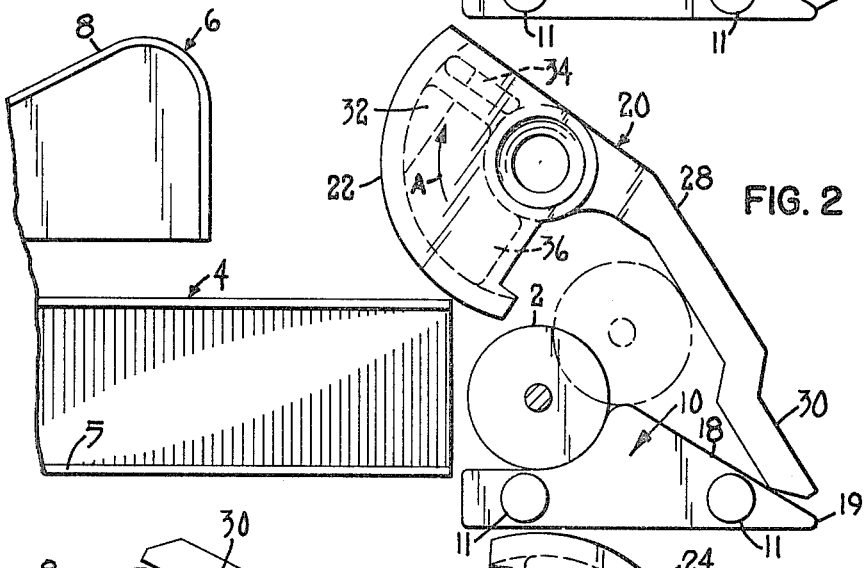
FIG. 2 is a side elevational view similar to FIG. 1 of the locking apparatus of this invention, particularly illustrating the lock member in a second position where the cams allows partial removal of the shelf shown in FIG. 1.

Assume, however, that an operator wishes to slide the shelf at least partially from the vending machine housing for the purposes of loading the shelf with food products or the like. In this event, the operator need only rotate the lock member 20 in a clockwise direction as illustrated by the arrow A in FIG. 2. Such rotation can be accomplished merely by pressing down on the outwardly extending handle 28. In the second position of the lock member 20 as shown in FIG. 2, the locking surface 22 of cam 24 has been rotated until it clears the front roller 2. Thus, with the operator holding down on the locking handle 28 with one hand, he can use his other hand to raise or tilt the front edge of the shelf upwardly. This causes the front rollers 2 on both sides of the shelf to move up the curved surface of stop members 14 until they rest on top of the apexes 16 generally adjacent handle 28. See the phantom line illustration in FIG. 2. The front rollers 2 in this position have been disengaged from their corresponding front stops 10. The operator can then release the handle 28 and simultaneously allow the front rollers 2 to slide down the ramp 18. Although cam 24 will reset to its locking position of FIG. 1 as soon as handle 28 is released, this is no longer of any consequence since the front rollers 2 have cleared the front stops 10. In addition, even if handle 28 is slow in clearing the path in front of the front rollers 2, the handle 28 does not in any way interfere with the outward movement of the rollers 2 since if the rollers engage the handle 28 they will merely cam the handle upwardly until it naturally swings out of the way due to the resetting motion of the lock member 20.

With the shelf now unlocked in the manner noted above such that the front rollers 2 have cleared the lock member 20, the shelf may then be slid out of the vending machine housing for the purposes of loading. In this regard, when the shelf reaches its loading position, both of the rear support rollers on the shelf will still be located behind the lock member 20. These rear support rollers will be arranged such that the rearmost support roller is located on slanted support surface 8 to allow the shelf to be tilted downwardly to ease the task of loading. See the above-referenced U.S. patent for further description regarding the tilting of the shelves.

Figure 3:
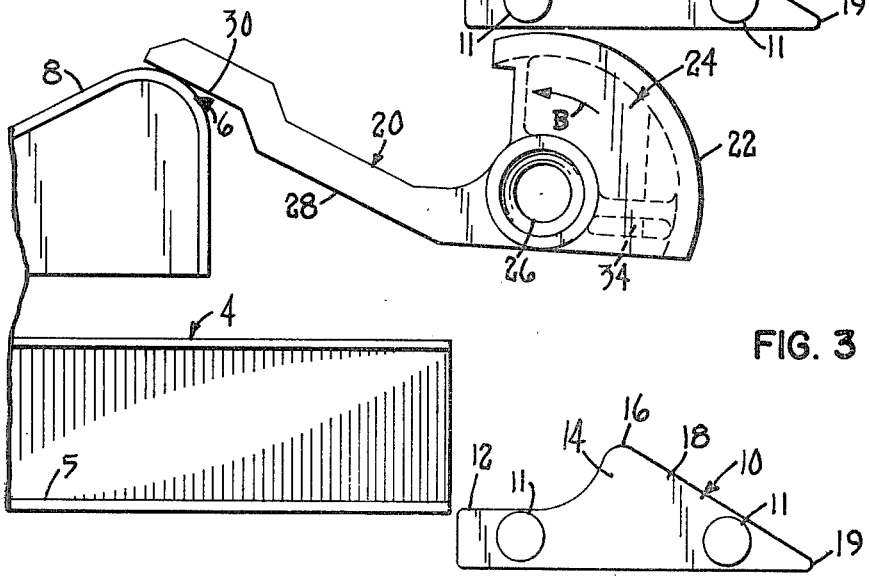
FIG. 3 is a side elevational view similar to FIGS. 1 and 2 of the locking apparatus of this invention, particularly illustrating the lock member in a third position in which the cam clears the front roller and is retained in the third position to allow complete removal of the shelf of FIG. 1 from the vending machine housing.

In order to completely remove the vending machine shelf from the vending machine housing (e.g., for the purpose of maintenance on motor or control mechanisms normally hidden by the shelf), lock member 20 is rotated manually in a counter-clockwise direction as shown by the arrow B until it reaches a third position as shown in FIG. 3. The lock member 20 will be retained in this position since its center of gravity is now located sufficiently far above and to the left of bore 26 in FIG. 3 such that the lock member 20 is urged in a counterclockwise direction of its own accord. However, lock member 20 does not simply reset to its FIG. 1 position since handle 28 will come into engagement either with support members 6 or with the top of track 4 if a support member 6 is not used with that particular shelf. In this regard, the notched outer end 30 is advantageous as it allows the handle 28 to engage the support member 6 at an angular orientation of lock member 20 which is greater than what would occur if the handle 28 were purely linear. Thus, lock member 20 can be manually rotated in a counterclockwise direction sufficiently far so that it will stay in its FIG. 3 orientation even with handle 28 in engagement with the front of support member 6.

In any event, with the lock member 20 disposed in its FIG. 3 orientation, the locking surface 22 of cam 24 has cleared the front rollers 2. Since lock member 20 will also stay by itself in its FIG. 3 orientation, both hands of the operator are free to manipulate the vending machine shelf. In this regard, the front of the shelf is first tilted up to clear the front rollers 2 over the front stops 10, and then the entire shelf is slid outwardly until the rear rollers are also caused to clear the stops 10. Thus, the FIG. 3 illustration of the lock member 20 illustrates one in which the lock member is located out of the way of the vending machine shelf support rollers to allow complete removal of the shelf from the vending machine housing.

This invention has been described primarily for use with helical coil vending machines as shown in the above-referenced U.S. patent which was incorporated by reference. However, this invention need not be limited for use in helical coil vending machines, but may be used with any vending machines having a plurality of vertically shaped shelves which are slidably located in a housing. All that is required is that some type of dispensing mechanism be located on each shelf for dispensing the products carried thereon. Furthermore, the shelf support members need not necessarily constitute rollers as shown herein although this is preferred. Any suitable type of shelf support member which is receivable between and slidable in the U-shaped tracks 4 could be used.

Thus, the scope of this invention is to be limited only by the appended claims.

What is claimed is:

1. An improved vending machine of the type having a housing; at least one shelf movably mounted in the housing for movement between a dispensing position located inside the housing and a loading position located at least partially outside the housing; dispensing means carried in the housing for dispensing products contained on each of the shelves; a front stop located at each side of the housing; a front shelf support member on each side of the shelf normally received in one of the front stops to retain the shelf in the housing in its dispensing position; and wherein the improvement relates to an apparatus for locking the shelf inside the housing, which locking apparatus comprises:

a lock member pivotably mounted in the housing above an adjacent one of the front stops for the shelf, the lock member having a locking surface and being counterweighted such that the lock member normally assumes a first position in which the locking surface interferes with removal of the front shelf support member from the adjacent front stop to thereby lock the shelf in its dispensing position; and wherein the locking member is rotatable a sufficient angular distance to a second position in which the locking surface clears the front shelf support member to allow the front shelf support member to be disengaged from the adjacent front stop and the shelf pulled outwardly in the housing.

2. An improved vending machine as recited in claim 1, wherein the lock member comprises:

(a) a locking cam having an arcuate periphery which defines the locking surface, the locking cam being located generally to one side of a bore for pivotably mounting the lock member in a housing; and (b) a handle located on an opposite side of the bore from the locking cam and extending outwardly therefrom.

3. An improved vending machine as recited in claim 1, wherein the locking cam, bore, and handle are all integrally formed in a single piece from plastic material.

4. An improved vending machine as recited in claim 2, in which the handle is located adjacent a front end of the shelf and extends sufficiently far outwardly to be accessible to an operator standing in front of the shelf.

5. An improved vending machine as recited in claim 1, wherein the locking surface is located immediately above the front shelf support member in the first position of the lock member to prevent the front shelf support member from being moved upwardly a sufficient distance to clear the front stop.

6. An improved vending machine of the type having a housing; a plurality of shelves located in the housing in a vertically spaced relationship, wherein each side of each shelf has a plurality of spaced laterally extending shelf support members received in aligned tracks in the housing for slidably supporting each shelf therein; and wherein a front shelf support member on each side of each shelf is normally received in an identical front stop located on either side of the housing to retain the shelf inside the housing; and wherein the improvement comprises:

a plurality of substantially identical lock members, wherein one lock member is pivotably located in the housing above one front stop of each shelf, and wherein each lock member comprises:

(a) a locking cam having a substantially arcuate locking surface and means for pivotably mounting the cam in the housing;

(b) a handle connected to the cam for use by an operator in manually rotating the lock member;

(c) wherein the cam and handle are configured relative to the pivotal mounting means such that the lock member is counterweighted to assume a first position in which the locking surface is located immediately above the front shelf support member to prevent removal of the shelf from the front stop, and wherein the lock member is rotatable in a first direction to a second position in which the locking surface clears the front shelf support member to allow removal of the shelf but in which a restoring force is present on the lock member to restore the lock member to the first position as soon as the lock member is released by the operator, and wherein the lock member is rotatable in a second direction to a third position in which the locking surface clears the front shelf support member, the lock member in the third position coacting with the housing such that it is held in the third position even after the lock member is released by the operator to allow complete removal of the shelf from the housing.

7. An improved vending machine of the type having a housing; at least one shelf movably mounted in the housing for movement between a dispensing position located inside the housing and a loading position located at least partially outside the housing; dispensing means carried in the housing for dispensing products contained on each of the shelves; a front stop located at each side of the housing; a front shelf support member on each side of the shelf normally received in one of the front stops to retain the shelf in the housing; and wherein the improvement relates to an apparatus for locking the shelf inside the housing, which locking apparatus comprises:

a lock member pivotably mounted in the housing above an adjacent one of the front stops for the shelf, the lock member having a locking surface and being counterweighted such that the lock member normally assumes a first position in which the locking surface interferes with removal of the front shelf support member from the adjacent front stop to thereby lock the shelf in its dispensing position; wherein the locking member is rotatable a sufficient angular distance to a second position in which the locking surface clears the front shelf support member to allow the front shelf support member to be disengaged from the adjacent front stop and the shelf pulled outwardly in the housing; wherein the lock member is further rotatable to a third position in which the locking surface clears the front shelf support member to allow the front shelf support member to be disengaged from the adjacent front stop, and wherein the lock member in its third position is configured to coact with the housing such that the locking surface of the lock member is retained out of interference with the front shelf support member, whereby an operator has both hands free to completely remove the shelf from the housing.

8. An improved vending machine as recited in claim 7, wherein the lock member includes a handle which extends outwardly from the locking surface, and wherein the handle has a notched outer end to allow greater angular rotation of the lock member to its third position whereby the lock member will be retained in its third position.

9. An improved vending machine of the type having a housing; at least one shelf movably mounted in the housing for movement between a dispensing position located inside the housing and a loading position located at least partially outside the housing; dispensing means carried in the housing for dispensing products contained on each of the shelves; a front stop located on at least one side of the housing; a front shelf support member on at least one side of the shelf normally received in the front stop to retain the shelf in the housing; and wherein the improvement relates to an apparatus for locking the shelf inside the housing, which locking apparatus comprises:

a lock member pivotably mounted in the housing above the front stop, the lock member having a locking surface and being rotatable between first and second positions, wherein the locking surface in the first position of the locking member interferes with removal of the front shelf support member from the front stop to thereby lock the shelf in its dispensing position, and wherein the locking surface in the second position of the lock member clears the front shelf support member to allow the front shelf support member to be disengaged from the front stop and the shelf pulled outwardly in the housing, and wherein the lock member includes means for normally biasing the lock member into the first position thereof.

* * * * *